US005108861A

United States Patent [19]

Kovacs et al.

[11] Patent Number: 5,108,861

[45] Date of Patent: Apr. 28, 1992

[54] EVAPORATED CUPROUS IODIDE FILMS AS TRANSPARENT CONDUCTIVE COATINGS FOR IMAGING MEMBERS

[75] Inventors: Gregory J. Kovacs; Carol A. Jennings, both of Mississauga, Canada

[73] Assignee: Xerox Corporation, Stamford, Conn.

[21] Appl. No.: 573,826

[22] Filed: Aug. 28, 1990

[51] Int. Cl.[5] ..... G03G 5/10

[52] U.S. Cl. ..... 430/63; 430/128; 430/131

[58] Field of Search ..... 430/62, 63, 69, 128, 430/131; 148/248; 427/250

[56] References Cited

U.S. PATENT DOCUMENTS

| | | | |
|---|---|---|---|
| 3,007,901 | 11/1961 | Minsk | 260/78 |
| 3,245,833 | 4/1966 | Trevoy | 117/201 |
| 3,262,807 | 7/1966 | Sterman et al. | 117/34 |
| 3,384,450 | 5/1968 | Trevoy et al. | 23/97 |
| 3,428,451 | 2/1969 | Trevoy | 96/1 |
| 3,505,131 | 4/1970 | Wells | 148/6.14 |
| 3,597,272 | 8/1971 | Gramza et al. | 117/218 |
| 3,607,388 | 9/1971 | Hori et al. | 117/224 |
| 3,661,648 | 5/1972 | Gerbier et al. | 136/120 |
| 3,677,816 | 7/1972 | Hayashi et al. | 117/217 |
| 3,871,972 | 3/1975 | Sekine | 204/2 |
| 3,898,672 | 8/1975 | Yasumori et al. | 346/135 |
| 3,905,876 | 9/1975 | Yoshino et al. | 204/2 |
| 4,069,356 | 1/1978 | Fischer | 427/76 |
| 4,133,933 | 1/1979 | Sekine et al. | 428/328 |
| 4,284,699 | 8/1981 | Berwick et al. | 430/96 |
| 4,321,073 | 3/1982 | Blair | 65/3.31 |
| 4,350,748 | 9/1982 | Lind | 430/49 |
| 4,485,161 | 11/1984 | Scozzafava et al. | 430/64 |
| 4,661,428 | 4/1987 | Ishida | 430/57 |
| 4,718,929 | 1/1988 | Power et al. | 423/489 |
| 4,758,486 | 7/1988 | Yamazaki et al. | 430/57 |

OTHER PUBLICATIONS

Journal of the Electrochemical Society, "Photosensitization of Semiconductor Electrode by Cyanine Dye in Lipid Bilayer" Feb. 1980, pp. 370–378; vol. 127; No. 2.

*Primary Examiner*—John Goodrow
*Attorney, Agent, or Firm*—Oliff & Berridge

[57] ABSTRACT

An electrostatographic device includes a metal halide conductive transparent layer which is free of nonuniformities. Very thin layers of metal halides are formed for imaging members by vacuum evaporation and exhibit adequate conductivity and transparency.

39 Claims, 1 Drawing Sheet

EVAPORATED CUPROUS IODIDE FILMS AS TRANSPARENT CONDUCTIVE COATINGS FOR IMAGING MEMBERS

BACKGROUND OF THE INVENTION

The present invention relates to imaging members. More particularly, the present invention relates to electrostatographic image transfer devices or imaging members comprising a transparent conductive layer of an evaporated metal halide. Electrostatographic image transfer devices are capable of having an image formed thereon which can be developed and transferred to a receiver such as a sheet of paper.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl layer and an optional overcoating layer.

Ionographic charge receivers are designed to be contacted with streams of ions from a source (e.g. corona, stylus, ionographic head, etc.) to form a charge pattern on the receiver which can subsequently be developed. Ionographic charge receivers generally comprise two layers, an inner electrically conductive layer and an outer dielectric layer. Ionographic charge receivers are typically made by coating dielectric material on a substrate made of a metal or alloy or a substrate having a conductive coating.

Back-side erasure of imaging members in electrostatographic devices may be desirable for a number of reasons. For example, erasure mechanisms located internal to an imaging belt for providing back-side erasure minimize the size requirements in electrostatographic devices. Also, back-side erasure devices located on an opposite side of an imaging belt in relation to imaging mechanisms reduce the overall complexity of an electrostatographic device and allow easy access to the individual components of the device.

Transparent imaging members are currently being developed. Conductive layers (ground planes) comprising cuprous iodide and other I-VII semiconductors such as CuBr, CuCl and the corresponding silver salts provide desirable conductive properties while maintaining the requisite transparency desired in such members. The I-VII semiconductors are a class of compounds formed from Group IB and Group VII elements of the Periodic Table. See, for example, a review article by A. Goldmann, "Band Structure and Optical Properties of Tetrahedrally Coordinated Cu- and Ag- Halides", Phys. Stat. Sol. (b) 81, 9–47(1977).

Generally, vacuum evaporation has only been used to produce semi-transparent coatings such as the semi-transparent Al or Ti coatings used for certain photoreceptor applications. Sputtering can be used to produce conductive transparent coatings of NESA ($SnO_2$) or ITO ($In_2O_3/SnO_2$), but sputtering is a very slow process with very low throughput. Vacuum evaporation of these compounds generally results in a reduced material which is conductive but not transparent. Extended high temperature post deposition oxidation (e.g., 400° C., 15 min.) treatment must be carried out to oxidize the evaporated material and thereby render it transparent.

U.S. Pat. No. 4,485,161 discloses an electrophotographic element comprising a conductive layer, a barrier layer and a photoconductive layer, all three of which can be coated by a variety of coating techniques such as spray coating, swirl coating, vacuum deposition, extrusion hopper coating, hand coating and air knife coating. The disclosure of the preparation of a conductive layer is limited. The patent states that the conductive layer is usually coated on a support and allowed to dry before a barrier layer is applied. A number of patents are referred to at column 7 regarding the conductive layer. These patents disclose solution coating techniques for applying a coating to a substrate. In each patent, a method is disclosed wherein a solution is applied to a substrate and the solvent is evaporated to form a film coating on the substrate. The examples of U.S. Pat. No. 4,485,161 refer to use of a polyester support which has previously been coated with a conductive layer of cuprous iodide.

U.S. Pat. No. 4,661,428 discloses at column 4 an electrically conductive substrate which may be a plate or cylindrical body made of a conductive metal whose volume resistivity is 1010 ohm-centimeter or less such as Al, Cu, Pb or the like, a plate or cylindrical body made of a metal oxide such as $SnO_2$, $In_2O_3$, CuI, $CrO_2$ or the like, or a plastic film, paper, cloth or the like on which said metal or metal oxide has been coated by vapor deposition or sputtering. The examples all use a 0.2 mm thick aluminum plate as the conductive substrate.

U.S. Pat. No. 3,871,972 describes an electrorecording sheet in which an electroconductive white or light yellow layer of cuprous iodide may be vacuum evaporated or solution coated onto a color forming layer containing a component which shows visual color change or color formation due to electrochemical reaction or heat energy when current is passed therethrough. When current is applied to the color forming layer through the electroconductive layer, selective visible recording is obtained in the current applied area of the color forming layer. While thickness of the electroconductive layer was not emphasized, Examples 3 and 4 describe solution coating of the electroconductive layer to a thickness of 15 micrometers.

Conductive coatings containing copper iodide have previously been prepared by dispersing CuI in a binder and casting a film from a non-aqueous solvent; U.S. Pat. No. 3,245,833 discloses such a preparation. There are problems, however, associated with this procedure. Examples of solvents used in such preparation include nitriles such as acetonitrile, propionitrile and butyronitrile. The solubility of CuI in these solvents is low and extensive filtration is required to remove particulates. Even after filtration, particulates grow in the solutions which lead to microscopic nonuniformities in films so produced. As a precaution, mixing and filtration is carried out in the dark because copper iodide is light sensitive. Oxidation of Cu(I) to Cu(II) is a problem since the latter form is nonconducting. Additionally, a drying step is necessary to remove solvent from such films.

U.S. Pat. No. 3,677,816 discloses a conductive, transparent CuI film formed by contacting an evaporated Cu film with an iodine containing solution. The resultant thin layer of copper iodide has a surface resistivity of $5\times10^3$ to $10^6$ ohms/L□ and a white light transmittance of 80% to 95%. Reference is made to prior art in which a cuprous iodide layer is formed by exposing a substrate surface to an atmosphere of copper vapor and then exposing the resulting copper coated surface to iodine vapor. This process is said to be disadvantageous in view of the extreme toxicity of iodine vapor, insufficient uniformity and insufficient adhesion. At col. 5, a method of producing a three-layered transparent film from an iodine containing solution is disclosed. The film has a top layer consisting of an organic photoconductive substance bonded together with a binder resin.

U.S. Pat. No. 3,505,131 describes a process for the preparation of clear, transparent cuprous iodide film for an electrostatic imaging system, comprising evaporating copper onto a substrate in the absence of substantially all oxygen and water to form a copper film, removing any oxide on the film by contact with a deoxidizer, removing the deoxidizer, and exposing the film to an iodine-hydrophobic solvent solution. Mechanical thicknesses greater than about 0.1 micrometer (optical thicknesses of over 0.2 micrometer) are disclosed.

U.S. Pat. No. 3,898,672 describes an electrosensitive recording member which works by sparking between a stylus and a recording electrode. The member is comprised of CuI, an electrically reducible metal compound, and an organic binder. A thickness of 5 to 100 micrometers is disclosed.

U.S. Pat. No. 3,905,876 discloses an electrorecording sheet in which the conductivity of a solution coated CuI layer is enhanced by increasing the iodine content relative to Cu by 0.05–0.2% by weight. The increase in iodine content can be effected by removing Cu+ ions by treatment with the oxidizing agent potassium permanganate. A small quantity of $KMnO_4$ is simply milled with the CuI powder. In this process some Cu+ is transformed to Cu2+ and some Cu+ is correspondingly liberated. The excess holes give enhanced p-type conductivity. To add excess iodine, materials such as iodoform are added to the milling mixture.

U.S. Pat. No. 4,133,933 discloses an electrorecording sheet with improved whiteness in the sheet which comprises precipitated cuprous iodide.

U.S. Pat. No. 3,661,648 describes a method for preparing electrochemical cell electrodes comprising providing a metallic copper containing carrier body, providing a concentrated non-aqueous solution of cupric chloride in organic solvent, and immersing the metallic copper carrier into said solution at ambient temperature. The resulting corrosive action of the cupric chloride on the metallic copper provides corrosive conversion of part of the copper metal of the carrier into cuprous chloride. The remaining unconverted metallic copper of the carrier serves as a conductive current carrier for the electrode.

U.S. Pat. No. 4,069,356 describes a method for forming photoconductive layers of chalcogenides of Cd or Zn with high photoconductivity gain. To provide high photoconductivity gain the material is typically doped with a metal (usually copper) and a halogen (usually chlorine). The method consists of forming a pellet from mixed powders of the chalcogenide and a small amount of copper halide, preferably between about 0.1% and 2.0% by weight of the total mixture. The pellet is then vacuum evaporated onto a substrate, typically to a thickness of 1–5 micrometers, and baked in an oxygen rich atmosphere. The baking allows diffusion of the halide donor and copper acceptor dopants into the crystal.

U.S. Pat. No. 4,284,699 discloses an electrical conducting support, for example, aluminum paper laminates; metal foils; metal plates; vacuum deposited metal layers such as silver, nickel, chromium, aluminum and the like coated on paper or conventional photographic film base such as cellulose acetate, polystyrene, polyethylene terephthalate; etc. Such conducting materials as nickel can be vacuum deposited on transparent film supports in sufficiently thin layers to allow electrophotographic layers prepared therefrom to be exposed through the transparent film support if so desired. Example 5 refers to a conductive layer of copper iodide.

U.S. Pat. No. 4,758,486 discloses an electrophotographic photoconductor comprising an electroconductive layer made of aluminum deposited on a support material by vacuum evaporation.

U.S. Pat. No. 3,428,451 discloses radiation sensitive recording elements comprising a conductive layer and a recording layer. The conductive layer may comprise cuprous iodide or another semiconductor compound dispersed in a resin binder.

U.S. Pat. No. 4,350,748 discloses a process of manufacturing printing forms or printed circuits by coating an electrically conductive support with an organic photoconductive layer. The materials to be coated may comprise metals such as aluminum, copper, zinc or magnesium or metal compounds such as aluminum oxide, zinc oxide, indium oxide or copper iodide. In one example, a film on which aluminum has been vapor deposited is used to transfer photoconductive material onto an aluminum plate.

Conductive substrates used previously for electrostatographic applications lack oxidative stability. A need therefore exists for an oxidatively stable conductive substrate for electrostatographic applications.

SUMMARY OF THE INVENTION

It is an object of the present invention to provide an electrostatographic imaging member comprising a transparent conductive layer which enables back side erasure of an electrostatic image formed on the member.

It is another object of the present invention to provide an electrostatographic imaging member which exhibits excellent oxidative stability over a long lifetime.

It is still another object of the present invention to provide an electrostatographic imaging member which comprises a conductive transparent layer which is relatively free of nonuniformities.

It is another object of the present invention to provide a method of forming a transparent conductive layer for an electrostatographic imaging member by a high-speed, high-throughput process.

The present invention relates to an electrostatographic device having a very thin evaporated metal halide transparent conductive layer. The device is easier to make and mechanically more robust than devices made by solution coating or sputtering of the conductive layer. The layer shows especially high oxidative stability under extended cycling and has a transparent nature free of nonuniformities. The invention further relates to a method of making such a device.

In a preferred embodiment, an electrophotoconductive imaging member comprises a supporting substrate, an electrically conductive transparent layer of a vacuum evaporated metal halide, a charge blocking layer, and at least one photoconductive layer. The conductive transparent layer preferably comprises cuprous iodide.

BRIEF DESCRIPTION OF THE DRAWINGS

A more complete understanding of the present invention can be obtained by reference to the Figures, wherein.

DESCRIPTION OF PREFERRED EMBODIMENTS

The electrostatographic imaging member according to the present invention contains a conductive transparent layer of an evaporated metal halide. The conductive layer of the invention allows for excellent back-side erasure of electrostatic images. The conductive layer may be comprised of any transparent conductive metal halide, most preferably cuprous iodide. Cuprous iodide can be represented by either of its formulae, i.e., CuI and $Cu_2I_2$ (see CRC Handbook of Physics and Chemistry, 70th edition 1989–1990).

Very thin transparent layers of conductive metal halides which show adequate electrical conductivity and optical density for ground plane and back-side erase applications can be produced and used in imaging members of the present invention. Vacuum evaporation is used to produce such layers. Layer thicknesses of about 10 nanometers or less may be obtained according to the present invention. A layer may be deposited on a substrate to form an overlying conductive layer relatively free of nonuniformities. When deposited on a transparent substrate, an imaging member can be produced which is capable of being photo-erased by a light source which illuminates through the substrate and the transparent conductive layer. Such layers can be used in both electrophotographic and ionographic imaging members.

Figure 1:
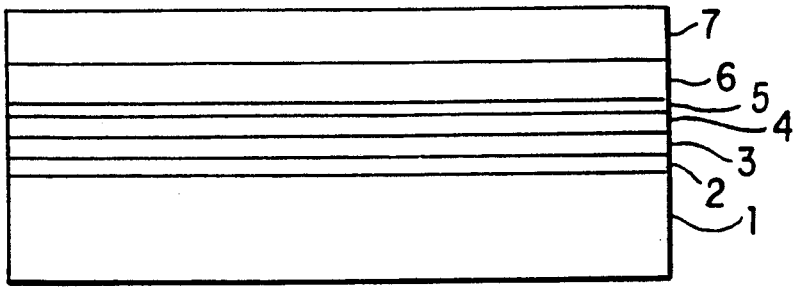
FIG. 1 is a cross-sectional view of a multilayer photoreceptor of the invention.

A representative structure of an electrophotographic imaging member is shown in FIG. 1. This imaging member is provided with a supporting substrate 1, an optional adhesive layer 2, an electrically conductive transparent ground plane (conductive layer) 3, a hole blocking layer 4, a second optional adhesive layer 5, a charge generating layer 6, and a charge transport layer 7. Optional layers such as an overcoating layer over the charge transport layer, and an anti-curl layer adjacent the substrate opposite to the imaging layers, may also be used in the device.

A description of the layers of the electrophotographic imaging member shown in FIG. 1 follows.

The Supporting Substrate

The supporting substrate 1 may be opaque or substantially transparent and may comprise numerous suitable materials having the required mechanical properties. There may be employed various resins known for this purpose including polyesters, polycarbonates, polyamides, polyurethanes, and the like. The substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex, available from ICI Americas Inc., or Hostaphan, available from American Hoechst Corporation. Other materials for the substrate include polymeric materials such as polyvinyl fluoride, available as Tedlar from du Pont, or polyimides, available as Kapton from du Pont.

The thickness of the substrate layer depends on numerous factors, including mechanical performance and economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example, less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The First Optional Adhesive Layer

An adhesive layer 2 may be coated onto the substrate 1 to promote adhesion of the conductive layer to the supporting substrate. The adhesive layer may be formed from film-forming polymers such as copolyester, for example, du Pont 49,000 resin (available from E. I. du Pont de Nemours & Co.), Vitel PE-100, Vitel PE-200, Vitel PE-200D and Vitel PE-222 (available from Goodyear Rubber & Tire Co.), and the like.

Du Pont 49,000 is a linear saturated copolyester of four diacids and ethylene glycol having a molecular weight of about 70,000 and a glass transition temperature of 32° C. Its molecular structure is represented as $$HO-\overset{\overset{O}{\|}}{C}+\text{Diacid-Ethylene glycol}+_{n}OH$$

where n is a number which represents the degree of polymerization and gives a molecular weight of about 70,000. The ratio of diacid to ethylene glycol in the copolyester is 1:1. The diacids are terephthalic acid, isophthalic acid, adipic acid and azelaic acid in a ratio of 4:4:1:1.

Vitel PE-100 is a linear copolyester of two diacids and ethylene glycol having a molecular weight of about 50,000 and a glass transition temperature of 11° C. Its molecular structure is represented as $$HO-\overset{\overset{O}{\|}}{C}+\text{Diacid-Ethylene glycol}+_{n}OH$$

where n is a number which represents the degree of polymerization and gives a molecular weight of about 50,000. The ratio of diacid to ethylene glycol in the copolyester is 1:1. The two diacids are terephthalic acid and isophthalic acid in a ratio of 3:2.

Vitel PE-200 is a linear saturated copolyester of two diacids and two diols having a molecular weight of about 45,000 and a glass transition temperature of 67° C. The molecular structure is represented as $$HO-\overset{\overset{O}{\|}}{C}+\text{Diacid-Diol}+_{n}OH$$

where n is a number which represents the degree of polymerization and gives a molecular weight of about 45,000. The ratio of diacid to diol in the copolyester is 1:1. The two diacids are terephthalic and isophthalic acid in a ratio of 1.2:1. The two diols are ethylene glycol and 2,2-dimethyl propane diol in a ratio of 1.33:1.

The adhesive layer should be continuous and preferably has a dry thickness between about 0.01 micrometers and about 2 micrometers, and more preferably between about 0.05 micrometers and 0.5 micrometers. At thicknesses less than about 0.01 micrometers, the adhesion between the substrate and the conductive layer is poor and spontaneous delamination occurs when the belt is transported over small diameter supports such as rollers and curved skid plates having 19 mm diameter of curvature. When the thickness of the adhesive layer is greater than about 2 micrometers, excessive residual charge build-up may be observed during extended cycling.

The adhesive layer is preferably applied as a solution. Any suitable solvent or solvent mixtures may be employed to form a coating solution. Typical solvents include tetrahydrofuran, toluene, methylene chloride, cyclohexane, and the like, and mixtures thereof. Any suitable coating technique may be utilized to mix and thereafter apply the adhesive layer coating mixture. Typical application techniques include spraying, dip coating, gravure coating, and the like. Drying of the deposited coating may be effected by any suitable conventional technique such as oven drying, infrared radiation drying, air drying and the like.

The Electrically Conductive Ground Plane

The electrically conductive ground plane 3 is an electrically conductive transparent layer which is formed by a vacuum evaporation of a suitable metal halide.

Devices fabricated with a conductive transparent ground plane and, as appropriate, a substantially transparent substrate may be photoerasable through the back-side. Further, they are easier to make and are mechanically more robust than devices made by solution coating or sputtering of the conductive ground plane.

Conductive transparent coatings of conductive metal halides are prepared according to the present invention by evaporation techniques, preferably by vacuum evaporation, a high-speed, high-throughput process. The process produces superior, more uniform coatings compared to standard solution and sputtering techniques.

Through the use of vacuum evaporation, layers having virtually no nonuniformities (e.g., particulates) can easily be produced having very low optical densities. Conductive layers having optical densities of less than about 0.1 may be produced according to the present invention. Conductive ground planes with optical densities in the visible and near infrared region of less than 0.4 are preferred for back-side photoerasable devices, optical densities of below 0.3 being more preferred, and Evaporation of metal halide onto a substrate is performed by heating the metal halide powder to high temperature and under high vacuum, while either maintaining the substrate at room temperature or heating the substrate also, appropriate ranges for temperature and pressure being well known to one of skill in the vacuum evaporation art.

Figure 2A:
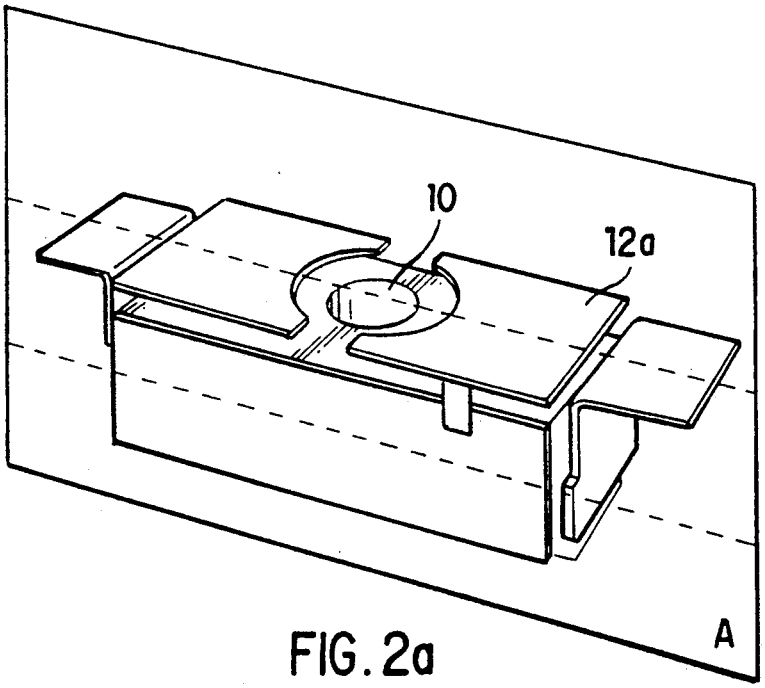
FIG. 2*a* is a perspective view of a chimney-type vacuum evaporation apparatus.
Figure 2B:
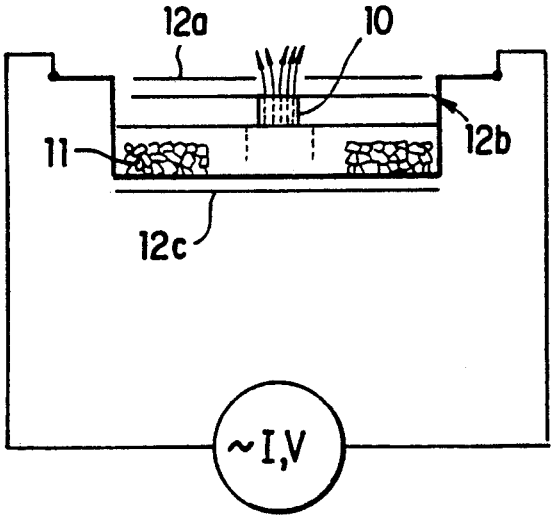
FIG. 2*b* is a cross-section of the chimney-type vacuum evaporation apparatus shown in FIG. 2*a* taken along plane A connected to a power supply as schematically represented.

A suitable device for effecting vacuum evaporation is a chimney-type apparatus (see FIGS. 2*a* and 2*b*). The use of a chimney-type apparatus prevents spitting of the evaporant and thereby substantially eliminates particulates in films. A chimney-type source made of tantalum may be used. An example is model SM-8 supplied by R. D. Mathis Co. As shown in FIG. 2*a*, the source has a chimney 10 through which evaporated metal halide is evaporated. FIG. 2*b* shows a cross-section of the source connected to a power supply. The evaporant material 11 escapes from the source through the chimney 10. Radiation shields 12*a*, 12*b* and 12*c* are provided to block stray radiation. CuI (Fisher purified C-465) may be evaporated from such an apparatus by heating it to about 400° C. This can be accomplished by applying about 60 amperes AC through the tantalum source at about 10 volts AC to result in the dissipation of about 600 watts during the deposition. With the vacuum held at a level of about $1\text{-}3\times10^{-5}$ torr, a deposition rate of about 1 nm/s results for a source to substrate distance of about 0.8 m. Good quality films result when the substrate is held at room temperature. If high adhesion is desired, the substrate may be heated to about 120° C. during the deposition.

Metal halides particularly useful for applications of the present invention include metal halides of the formulae MX, $MX_2$, $MX_3$ and $M_2X_2$ wherein M is a metal, preferably Cu or Ag, and X is a halogen selected from Cl, Br and I, preferably I. Of these, preferred metal halides include CuI, $Cu_2I_2$, CuBr, CuCl, AgI, AgBr and AgCl, especially CuI and $Cu_2I_2$.

The conductive layer may be of thicknesses within a substantially wide range depending on the optical transparency, conductivity and flexibility desired for the imaging member. For a flexible imaging device, the thickness of the conductive layer is preferably below about 100 nanometers, and more preferably below about 75 nanometers for an optimum combination of electrical conductivity, flexibility and light transmission. Conductive layers of below about 50 nanometers are considered highly preferred, below about 40 nanometers, more preferred, below about 30 nanometers even more preferred, and those below about 20 nanometers are most preferred. In a most preferred embodiment, a conductive ground plane layer thickness of between about 10 nm and 20 nm may provide adequate conductivity for electrophotographic applications with an optical density at extremely low levels.

Films produced by evaporation onto room temperature substrates have reasonable abrasion resistance; evaporation onto heated substrates could produce films with improved abrasion resistance, as it does with $MgF_2$, for example. Substrate temperatures between about 100° C. and 150° C. are preferred. The substrate and metal halide may be heated prior to and/or during vacuum evaporation. Heated substrates may not, however, be necessary and tend to increase the overall complexity and cost of the evaporation process.

Evaporated cuprous iodide layers show excellent oxidative stability in photoreceptor applications, enabling extended photoreceptor life. The relative oxidative stability of cuprous iodide compared to other photoreceptor ground planes makes cuprous iodide a preferred conductive ground plane layer.

The Blocking Layer

After formation of the electrically conductive ground plane layer, the blocking layer may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. When a material such as cuprous iodide is used in the conductive layer, it is necessary to employ a blocking material which does not react with the material of the conductive layer. In particular, materials for the blocking layer which contain amino, imino or tertiary amine groups, such as nitrogen containing amines, may react with the conductive layer. Such interactions have deleterious effects on the properties of the conductive layer and, in particular, reduce or destroy the electrical conductivity of that layer. Thus, use of these materials is not preferred unless the materials are modified to render them incapable of interacting with the conductive layer. Modification may be achieved by metal-complexing the amino, imino or tertiary amine groups of the charge blocking material, thereby rendering innocuous the deleterious effects of these groups.

The charge blocking material of the invention may include any polymer containing amine, imino or tertiary amine groups. Examples include polyethyleneimine, n-ethylpolyethyleneimine, polyvinylbutyral, epoxy resins, polyesters, polysiloxanes, polyamides, polyurethanes and the like, or may be modified nitrogen-containing siloxanes or nitrogen-containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethyl-ethylamino)titanate, titanium-4amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxy-silane, $[H_2N(CH_2)_3]CH_3Si(OCH_3)_2$, and (gamma-aminopropyl) methyl diethoxysilane, as disclosed in U.S. Pat. Nos. 4,338,387, 4,286,033 and 4,291,110.

The complexing material may be any material capable of complexing with the amino, imino or tertiary amine group of the charge blocking material. The complexing material may be a metal, a metal ion or metal-containing compound. Preferred metals include transition metals, for example, copper, silver, gold, nickel, palladium, platinum, cobalt, rhodium, iridium, iron, ruthenium, osmium, manganese, chromium, vanadium, titanium, zinc, cadmium, mercury, lead, etc. Preferably, transition metals are used which coordinate nitrogen or other ligand atoms in the charge blocking material. Preferably, transition metals are used which can form square planar or octahedral coordination complexes. The metal ions may be provided in a solution which is added to a hydrolyzed silane solution, and chemically reacted. The resulting solution may then be coated as a charge blocking layer and dried. The dried charge blocking layer is substantially uniform throughout the layer. That is, the layer contains a uniform mixture of the complexed or chelated blocking material.

The blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness of between about 0.03 micrometer and about 0.06 micrometer is preferred for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of blocking layer material and solvent of between about 0.05:100 to about 0.5:100 is satisfactory for spray coating.

The Second Optional Adhesive Layer

In most cases, intermediate layers between the blocking layer and the adjacent charge generating or photogenerating layer may be desired to promote adhesion. For example, the optional adhesive layer 5 may be employed. If such layers are utilized, they preferably have a dry thickness between about 0.001 micrometer to about 0.2 micrometer. Typical adhesive layers include film-forming polymers such as polyester, du Pont 49,000 resin (available from E. I. du Pont de Nemours & Co.), polyvinylbutyral, polyvinylpyrrolidone, polyurethane, polymethyl methacrylate, and the like.

The Charge Generating Layer

Any suitable charge generating (photogenerating) layer may be applied to the blocking layer. If an optional adhesive layer is applied to the blocking layer, then the photogenerating layer is coated to that adhesive layer. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide; and phthalocyanine pigment such as the X-form of metal-free phthalocyanine described in U.S. Pat. No. 3,357,989; metal phthalocyanines such as vanadyl phthalocyanine and copper phthalocyanine; dibromoanthanthrone; squarylium; quinacridones available from du Pont under the tradename Monastral Red, Monastral Violet and Monastral Red Y; Vat orange 1 and Vat orange 3 (trade names for dibromo anthanthrone pigments); benzimidazole perylene; substituted 2,4-diamino-triazines disclosed in U.S. Pat. No. 3,442,781; polynuclear aromatic quinones available from Allied Chemical Corporation under the tradename Indofast Double Scarlet, Indofast Violet Lake B, Indofast Brilliant Scarlet and Indofast Orange; and the like, dispersed in a film forming polymeric binder. Multiphotogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, titanyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, titanyl phthalocyanine, metal-free phthalocyanine and tellurium alloys are also preferred because these materials provide the additional benefit of being sensitive to infrared light.

Any suitable polymeric film-forming binder material may be employed as the matrix in the photogenerating layer. Typical polymeric film-forming materials include those described, for example, in U.S. Pat. No. 3,121,006. If an adhesive layer is used between the blocking and photogenerating layers, the binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like, and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected, provided the objectives of the present invention are achieved.

Any suitable and conventional technique may be utilized to mix and thereafter apply the photogenerating layer coating mixture to the previously applied blocking layer (or dried adhesive layer, if used). Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The Charge Transport Layer

The charge transport layer 7 may comprise any suitable transparent organic polymer or non-polymeric material capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack, and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is normally transparent in a wavelength region in which the photoconductor is to be used when exposure is effected therethrough to ensure that most of the incident radiation is utilized by the underlying charge generating layer. When used with a transparent substrate, imagewise exposure or erasure may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds or charge transport molecules dispersed in normally electrically inactive film-forming polymeric materials for making these materials electrically active. These charge transport molecules may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge-transporting aromatic amine, and about 75 percent to about 25 percent by weight of a polymeric film-forming resin in which the aromatic amine is soluble.

The charge transport layer is preferably formed from a mixture comprising at least one aromatic amine compound of the formula:

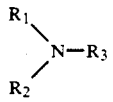

wherein $R_1$ and $R_2$ are each an aromatic group selected from the group consisting of a substituted or unsubstituted phenyl group, naphthyl group, and polyphenyl group and $R_3$ is selected from the group consisting of a substituted or unsubstituted aryl group, an alkyl group having from 1 to 18 carbon atoms and a cycloaliphatic group having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

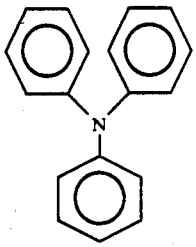

II. Bis and poly triarylamines such as:

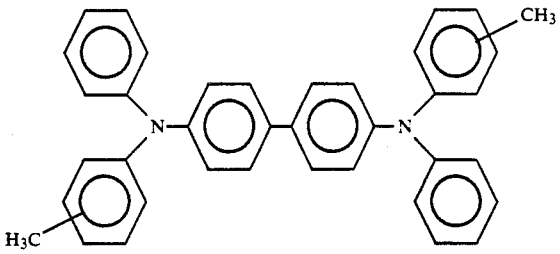

III. Bis arylamine ethers such as:

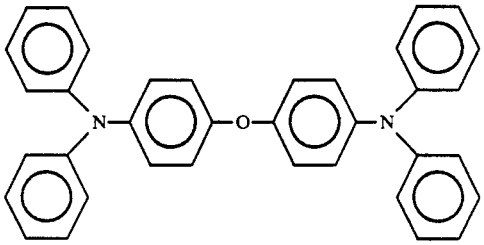

and

IV. Bis alkyl-arylamines such as:

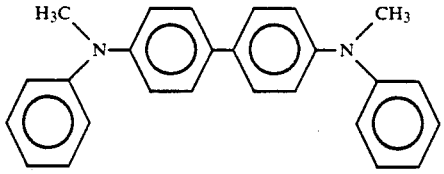

A preferred aromatic amine compounds has the general formula:

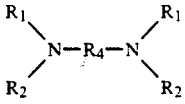

wherein $R_1$ and $R_2$ are defined above, and $R_4$ is selected from the group consisting of a substituted or unsubstituted biphenyl group, a diphenyl ether group, an alkyl group having from 1 to 18 carbon atoms, and a cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4-4'-bis(diethylamino)-2,2'-dimethyltriphenylmethane; N,N'-bis(alkylphenyl)-(1,1'-biphenyl)-4,4'-diamine wherein the alkyl is, for example, methyl, ethyl, propyl, n-butyl, etc.; N,N'-diphenyl-N,N'-bis(3-methylphenyl)-(1,1'biphenyl)-4,4'-diamine; and the like, dispersed in an inactive resin binder.

Any suitable inactive resin binder soluble in methylene chloride or other suitable solvents may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farbenfabricken Bayer A. G.; a polycarbonate resin having a molecular weight of from about 20,000 to about 50,000, available as Merlon from Mobay Chemical Company; polyether carbonates; and 4,4'-cyclohexylidene diphenyl carbonate. Methylene chloride solvent is a desirable component of the charge transport layer coating mixture for adequate dissolving of all the components and for its low boiling point.

An especially preferred multilayer photoconductor comprises a charge generating layer comprising a binder layer of pohotoconductive material and a contiguous hole transport layer of a polycarbonate resin material having a molecular weight of from about 20,000 to about 120,000, having dispersed therein from about 25 to about 75 percent by weight of one or more compounds having the formula:

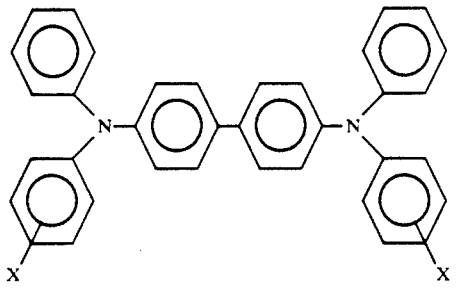

wherein X is selected from the group consisting of an alkyl group, having from 1 to about 4 carbon atoms, and chlorine, the photoconductive layer exhibiting the capability of photogeneration of holes and injection of the holes, the hole transport layer being substantially nonabsorbing in the spectral region at which the photoconductive layer generates and injects pohotgenerated holes but being capable of supporting the injection of photogenerated holes from the photoconductive layer and transporting the holes through the hole transport layer.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Anti-Curl Layer

An optional anti-curl layer may be provided which comprises organic polymers or inorganic polymers that are electrically insulating or slightly semi-conductive. The anti-curl layer provides flatness and/or abrasion resistance. If an imaging member is to be formed which is capable of back-side erasure, it may be necessary that the anti-curl layer be transparent.

The anti-curl layer may be formed at the back side of the substrate 1, opposite to the imaging layers. The anti-curl layer may comprise a film forming resin and an adhesion promoter polyester additive. Examples of film forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film forming resin addition. The thickness of the anti-curl layer is from about 3 micrometers to about 35 micrometers, and preferably about 14 micrometers. Layer compositions and thicknesses may be chosen to provide an anti-curl layer having adequate anti-curl properties and transparency.

The Overcoating Layer

An optional overcoating layer may be provided on top of the imaging layers which comprises organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

EXAMPLE I

A conductive transparent ground plane for an electrophotographic device was prepared as follows:

CuI powder (Fisher Scientific, C-465) was evaporated from a tantalum chimney-type source (R. D. Mathis, SM-8) in a diffusion-pumped vacuum system (VG DPUHV 12). The substrate was Corning 7059 glass at room temperature. The film thickness was 100 nm as measured by a quartz crystal monitor. The film produced on glass was optically clear and homogeneous with a slight yellow tint; no particulates could be seen under microscopic observation. The optical density of the film was about 0.1 except in the violet, where it rose to about 0.3. Conductivity measurements were made with the 4-point probe technique and sheet resistance was determined to be about $1\times10^4$ ohms/square. This level of conductivity is more than adequate for most electrophotographic applications.

The oxidative stability of a photoreceptor device comprising a ground plane of evaporated CuI was tested and compared to a photoreceptor device having an aluminum/polyester ground plane. Example II below shows the test conditions and results.

EXAMPLE II

Device II was prepared as follows:

A glass substrate was coated with a layer of evaporated CuI about 100 nm thick. To this a layer of amorphous Se was applied through evaporation to a thickness of about 500 nm, followed by a layer of N,N'-diphenyl-N,N'-bis(3-methylphenyl)-1,1'-biphenyl-4,4'-diamine in Makrolon (a polycarbonate resin commercially available from Farbenfabricken Bayer A. G.), about 25 micrometers thick coated from dichloromethane. On top of this a carbon paste top electrode was applied having an area of 1 $cm^2$.

Device III was prepared from a substrate comprising a semi-transparent Al layer on a polyester support having a layer of amorphous Se evaporated thereon to a thickness of about 500 nm. On top of the amorphous Se layer, a layer of N,N'-diphenyl-N,N'-bis(3-methylphenyl)-1,1'-biphenyl-4,4'-diamine in Makrolon was coated from dichloromethane to a thickness of about 25 micrometers. A carbon paste top electrode having an area of 1 $cm^2$ was finally applied.

Approximately −200 V was initially applied between the top carbon electrode and the bottom electrode in both samples. The samples were kept under constant illumination to provide a source of charge carriers for current flow. Fan cooling was provided to prevent sample heating under illumination. Device II was run over several days for a total of 38 hours with the relative humidity ranging from 85% to 95% and the temperature from 70° F. to 75° F. Initially, it was necessary to slightly increase the voltage to maintain the 1 microampere/$cm^2$ current. The sample then ran continuously for a total of 38 hours before the experiment was terminated. There was no sign of current degradation or CuI oxidation. Device III was run under conditions of 85% RH and 72° F. It was necessary constantly to increase the voltage to maintain a 1 microampere/$cm^2$ current in this sample. After about 6 hours at this current level severe damage occurred to the Al electrode and current could no longer be maintained.

No evidence of oxidative erosion after 38 hours of continuous current flow, at 1 microampere/$cm^2$ through a photoreceptor device, was found in the CuI ground plane device. By comparison, a similar photoreceptor device made from a substrate comprising a semi-transparent Al layer on a polyester support lasted only about 6 hours before the Al layer had been completely oxidized and current flow ceased.

Evaporated CuI conductive transparent ground planes therefore have very high oxidative stability, unlike semi-transparent Al electrodes. Similar conditions were used to show that Zr electrodes undergo oxidation in about 8 hours.

While the present invention has been shown to be useful in electrophotography, many other applications for conductive transparent coatings of this type are possible. It is to be understood that the present invention is not limited to the specific embodiments described herein. It will be appreciated by those skilled in the art that additions, modifications, substitutions and deletions may be made without departing from the scope of the invention defined in the appended claims.

What is claimed is:

1. An imaging member comprising an electrically conductive transparent layer of a metal halide, said layer being formed by vacuum evaporation of said metal halide and having a thickness of less than about 100 nanometers.

2. An imaging member as in claim 1, wherein said metal halide is at least one member - selected from the group consisting of CuI, $Cu_2I_2$, CuBr, CuCl, AgI, AgBr and AgCl.

3. An imaging member as in claim 2, wherein said metal halide is cuprous iodide.

4. An imaging member as in claim 1, wherein said electrically conductive layer has a thickness of less than about 75 nm.

5. An imaging member as in claim 1, wherein said electrically conductive layer has a thickness of less than about 50 nm.

6. An imaging member as in claim 1. wherein said electrically conductive layer has a thickness of less than about 40 nm.

7. An imaging member as in claim 1, wherein said electrically conductive layer has a thickness of less than about 30 nm.

8. An imaging member as in claim 1, wherein said electrically conductive layer has a thickness of less than about 20 nm.

9. An imaging member as in claim 1, wherein said electrically conductive layer has a thickness between about 10 nm and about 20 nm.

10. An imaging member as in claim 1, wherein said electrically conductive layer has an optical density of less than about 0.4.

11. An imaging member as in claim 10, wherein said optical density is less than about 0.3

12. An imaging member as in claim 10, wherein said optical density is less than about 0.2.

13. An imaging member as in claim 10, wherein said optical density is less than about 0.1.

14. An imaging member as in claim 1, further comprising a supporting substrate for said electrically conductive layer.

15. An imaging member as in claim 14, wherein said substrate comprises transparent polyester.

16. An imaging member as in claim 1, wherein said imaging member is a photoreceptor.

17. An imaging member as in claim 1, wherein said imaging member is an ionographic receiver.

18. A method of forming an electrostatographic image transfer device, comprising vacuum evaporating an electrically conductive transparent layer of a metal halide onto a support to a thickness of less than about 100 nanometers and applying at least an imaging layer over said electrically conductive layer.

19. A method as in claim 18, wherein said support comprises transparent polyester.

20. A method as in claim 18, wherein said metal halide is at least one member selected from the group consisting of CuI, $Cu_2I_2$, CuBr, CuCl, AgI, AgBr and AgCl.

21. A method as in claim 20, wherein said metal halide is cuprous iodide.

22. A method as in claim 18, wherein said method further comprises the step of heating said metal halide and said support prior to said vacuum evaporation.

23. A method as in claim 18, wherein said method further comprises heating said metal halide and said support during evaporation.

24. A method as in claim 18, wherein said imaging layer is a dielectric layer.

25. A method as in claim 21, wherein said method further comprises heating said cuprous iodide prior to said vacuum evaporation while maintaining said support at approximately room temperature.

26. A method as in claim 21, wherein said method further comprises heating both said cuprous iodide and said support under vacuum prior to said vacuum evaporation.

27. A method as in claim 18, wherein said thickness is less than about 75 nm.

28. A method as in claim 18, wherein said thickness is less than about 50 nm.

29. A method as in claim 18, wherein said thickness is less than about 40 nm.

30. A method as in claim 18, wherein said thickness is less than about 30 nm.

31. A method as in claim 18, wherein said thickness is less than about 20 nm.

32. A method as in claim 18, wherein said thickness is between about 10 and about 20 nm.

33. A method as in claim 18, wherein said electrically conductive transparent layer is formed with an optical density of less than about 0.4.

34. A method as in claim 18, wherein said electrically conductive transparent layer is formed with an optical density of less than about 0.3.

35. A method as in claim 18, wherein said electrically conductive transparent layer is formed with an optical density of less than about 0.2.

36. A method as in claim 18, wherein said electrically conductive transparent layer is formed with an optical density of less than about 0.1.

37. A method as in claim 18, wherein said vacuum evaporating is performed using a chimney-type vacuum evaporation device.

38. A method of producing an electrophotographic image transfer device comprising vacuum evaporating a transparent electrically conductive layer of cuprous iodide on a polyester support, and applying at least a photogenerating and a photoconductive layer over said electrically conductive layer.

39. A method as in claim 38, wherein said vacuum evaporating is performed using a chimney-type vacuum evaporation device.

* * * * *